US006823787B1

(12) United States Patent
Saueressig

(10) Patent No.: US 6,823,787 B1
(45) Date of Patent: Nov. 30, 2004

(54) EXPANDABLE LAYER MADE OF COMPRESSIBLE MATERIAL

(75) Inventor: Kilian Saueressig, Vreden (DE)

(73) Assignee: Saueressig GmbH & Co., Vreden (DE)

( * ) Notice: Subject to any disclaimer, the term of this patent is extended or adjusted under 35 U.S.C. 154(b) by 0 days.

(21) Appl. No.: 09/959,314

(22) PCT Filed: Apr. 6, 2000

(86) PCT No.: PCT/DE00/01092

§ 371 (c)(1),
(2), (4) Date: Feb. 22, 2002

(87) PCT Pub. No.: WO00/64675

PCT Pub. Date: Nov. 2, 2000

(30) Foreign Application Priority Data

Apr. 23, 1999 (DE) ..... 199 18 432

(51) Int. Cl.[7] ..... B41F 13/10
(52) U.S. Cl. ..... 101/376; 492/48
(58) Field of Search ..... 101/152, 153, 101/170, 375, 376, 395; 492/4, 48

(56) References Cited

U.S. PATENT DOCUMENTS 3,253,323 A * 5/1966 Saueressig ..... 492/4
3,978,254 A * 8/1976 Hoexter et al. ..... 428/36.91
4,378,622 A * 4/1983 Pinkston et al. ..... 29/895.21
4,685,393 A * 8/1987 Saueressig ..... 101/375
4,864,926 A 9/1989 Saueressig
4,903,597 A * 2/1990 Hoage et al. ..... 101/401.1
5,669,045 A * 9/1997 Swain ..... 399/159
5,860,360 A * 1/1999 Lane et al. ..... 101/376
6,382,102 B1 * 5/2002 Herrmann et al. ..... 101/376

FOREIGN PATENT DOCUMENTS

DE 26 20 549 11/1977
DE 196 34 033 3/1998
EP 0 196 443 10/1986
EP 1 004 455 A2 5/2000

* cited by examiner

*Primary Examiner*—Ren Yan
(74) *Attorney, Agent, or Firm*—Aslan Baghdadi

(57) ABSTRACT

An expandable layer made of compressible material placed in a rotary printing from between a core cylinder and a sleeve. An embodiment includes depressions on the outer circumferential surface and/or the inner circumferential surface of the expandable layer. The depressions can be, at least partly, fashioned as open circumferential annular channels. In addition, at least some of the depressions and annular channels can be arranged according to a required bending compensation of the sleeve. In another embodiment, an initial section of the depressions stretches in an axial direction on the expandable layer and a subsequent section of the depressions stretches in a radial direction over the expandable layer, whereby a part of the material of the expandable layer can be displaced in the depressions and at least a portion of the depressions is arranged according to a required bending compensation of the sleeve.

21 Claims, 1 Drawing Sheet

EXPANDABLE LAYER MADE OF COMPRESSIBLE MATERIAL

This application claims priority to German Application No. DE 199 18 432.1, filed on Apr. 23, 1999, and PCT/DE00/01092 filed on Apr. 6, 2000, both of which are herein incorporated by reference in their entirety.

BACKGROUND

1. Field of the Invention

The present invention relates generally to rotary printing form processes, and more particularly, to an expandable layer made of compressible material placed in a rotary printing form between a core cylinder and a sleeve.

2. Background of the Invention

Primarily two different rotary printing form processes are used in the printing industry.

In the intaglio printing process metallic cylinders fitted with a function profile on the surface are predominantly used. Usually, steel rollers are galvanically plated with a copper layer, which then carries the function profile.

In flexography printing, rotary printing forms, which have a sleeve fitted onto a metallic roller core are often used. The sleeves are often galvanically made into, for example, nickel sleeves or consist of fiber reinforced thermoplastic materials. The function profile is located on the outer surface of the sleeve.

Other technical areas use metallic cylinders with a technical surface, for example, coatings of polytetrafluoroethylene, which have an anti-adhesive effect, metallic sleeves or hollow cylinders with a technical surface as well as rolled fiber reinforced thermoplastic sleeves with a technical surface. Similar to the manner in which the sleeves in flexography printing are attached, the technical sleeves could then be pneumatically attached to the roller core. They are also used as pipes or semi-finished products for cylinder production.

Sleeves are more and more often produced using thermoplastic pipes or flexible hoses or they are made of composites. The rubular semi-finished products are attached or as the case may be lead onto a conical cylinder using a heat source. This is described in further detail in the unpublished application DE 198 54 735.8. Non-conical production cylinders, too, could be used for the sleeve production. After heating the production cylinder using, for example, a heat transporting liquid or a pre-connected heating process, the rubular semi-finished product is pushed onto the production cylinder using a force fit direction. It is also possible to lead the semi-finished product directly from an extruder onto the production core. After the attachment process the production core is cooled so the thermoplastic material of the sleeve consolidates. Depending on the adjustment of the production parameter, the post consolidation frozen tensile strengths can be adjusted in such a manner that the sleeve remains on the production cylinder or that it will be de-molded. The de-molding could occur with the help of, for example, a scraper.

The de-molded sleeves could be placed on and removed from a corresponding core cylinder. This could occur pneumatically or mechanically. The connection of the sleeve to the core cylinder, which is made of, for example, steel or synthetics, can occur using frictional resistance or a mold clamping mechanism. When using a frictional resistance connection, the sleeve is made on a production core, which has a slightly smaller diameter than the ultimate core cylinder. The production core may also show the same deviations whereby the residual stress generated during the production is taken advantage of.

When using the mold clamping mechanism connection, the sleeves are made on a production core, which is fined with geometric structures, for example, grooves that are cast into the sleeves. The core cylinder carries the complimentary structure so that this combination will constitute the mold clamping mechanism.

It has proven to be advantageous, as has been described in DE 198 34 735, to provide the core cylinder or, as the case may be, also the sleeve with a compressible expandable layer. Should the sleeve material not show enough elasticity itself, such an expandable layer will have a balancing effect. This expandable layer is, in particular, necessary when the sleeve must be attached in a detachable union. It prevents the sleeve from being damaged by the high pressure during attachment and removal. Furthermore, the use of an expandable layer can evenly distribute the surface pressure on the sleeve. An expandable layer is also necessary during de-molding using air to allow the air cushions to be effective on the entire surface in order to ensure problem free attachment and removal of the sleeve.

Furthermore, the expandable layer has the advantage that small irregularities on, for example, the inner tubular surface of the main casting do not have an effect on the sleeve since they are smoothed out later on the core cylinder by the expandable layer. Expensive interior work such as honing is thus not necessary. It is also in this manner that other critical semi-finished products such as extruded thermoplastic pipes or composite plastic pipes produced using pultrusion can substitute for the sleeve. It remains an advantage that geometric structures can be cast on the production cylinder during production.

In this manner the expandable layer on the one hand stores the force, which is necessary for the frictional resistance connection between the core cylinder and the sleeve and provides the force locking between the two. Simultaneously, the surface pressure is evenly distributed.

As mentioned above, a function profile is introduced in the sleeve after the production process. This could occur through direct structuring using a laser beam, through de-ionization or through mechanical machining. In a second process, coatings made of polyurethane, polytetrafluoroethylene, copper, and other such materials can be positioned and will then be available as a functional layer. Flexography printing blocks may be directly attached. Depending on the ultimate purpose, tubular main castings of different materials and sizes are used. The use of expandable layers allows the sleeve itself to have a thick wall thickness so that it can only be slightly stretched.

The sleeve is used as a printing form for intaglio printing, flexography printing, or for embossing, and with the help of lasers mesh structures may also be introduced into the sleeve.

It can be used as a technical sleeve and would in that case be inserted without core cylinder.

The functional layer could also be, for example, a surface layer protection.

The function profile also includes penetrations, perforations, and the like through the sleeve. In this manner it is also possible to perforate the sleeve as a sieve. Then such a sleeve could, for example, be used as a rotation sieve for the straining of bulk materials, or as a suction cylinder, for example, for the removal of foils or for the draining of water from paper.

Due to the flexible character of the surface it may also be used as a textile-printing stencil.

EP 0 196 443 A2 discloses a sleeve with an inner layer made of an elastic rubber material and which is provided with circumferentially running channels on its outer surface. Forced-draft ducts are filled with compressed air during attachment and have no influence on the compressibility of the layer in which they are located. A similar sleeve is described in U.S. Pat. No. 4,864,926. Both sleeves must be attached using compressed air.

SUMMARY OF THE INVENTION

It can be concluded from the discussion above that the expandable layer is of particular importance. Therefore, it is the purpose of the invention to make available an expandable layer, between a core cylinder and a rotary printing form, that better fulfills the task that confront it, and through which especially a sleeve can be attached in an improved manner.

In an embodiment of the present invention this task is solved through the use of an expandable layer made of a compressible material, which is attached to a rotary printing form between a core cylinder and a sleeve. The expandable layer has depressions on its outer circumferential surface and/or inner circumferential surface.

In a further aspect of the present invention, the depressions are fashioned, at least partly, as open circumferential annular channels.

In a further aspect of the present invention, the annular channels are run parallel to each other.

In a further aspect of the present invention, the annular channels are placed equidistantly.

In a further aspect of the present invention, the depressions, at least partly, are fashioned as channels for use with liquid or gaseous media.

In a further aspect of the present invention, the expandable layer is fitted with surface layer protection on its outer circumferential surface.

In a further aspect of the present invention, the expandable layer is made of an elastic material with gaseous filling, for example, plastic foam or expanded polystyrene pellets.

In a further aspect of the present invention, the elastic material and/or the surface protection layer is fined with electrical conduction particles.

In a further aspect of the present invention, at least some of the depressions or annular channels are arranged according so the required bending compensation of the sleeve.

In a further aspect, the present invention provides an expandable layer made of compressible material, which could be fitted to a rotary printing form between a core cylinder and a sleeve. Depressions are fitted on the outer circumferential surface or on the inner circumferential surface of the expandable layer. An initial section of the depressions stretches in an axial direction on the expandable layer. A subsequent section of the depressions stretches in a radial direction over the expandable layer, whereby a part of the material of the expandable layer can be displaced in the depressions and at least a portion of the depressions is arranged according to a required bending compensation of the sleeve.

In a further aspect, the present invention provides a core cylinder with an expandable layer made of compressible material, which is adapted to be attached to a rotary printing form between the core cylinder and a sleeve. Depressions are fitted on the outer circumferential surface or on the inner circumferential surface of the expandable layer. An initial section of the depressions stretches in an axial direction on the expandable layer. A subsequent section of the depressions stretches in a radial direction over the expandable layer, whereby a part of the material of the expandable layer can be displaced in the depressions and at least a portion of the depressions is arranged according to a required bending compensation of the sleeve.

In a further aspect, the present invention provides a rotary printing form with an expandable layer made of compressible material, which is attached to the rotary printing form between a core cylinder and a sleeve. Depressions are fitted on the outer circumferential surface or on the inner circumferential surface of the expandable layer. An initial section of the depressions stretches in an axial direction on the expandable layer. A subsequent section of the depressions stretches in a radial direction over the expandable layer, whereby a part of the material of the expandable layer can be displaced in the depressions and at least a portion of the depressions is arranged according to a required bending compensation of the sleeve.

DETAILED DESCRIPTION OF THE INVENTION

Figure 1:
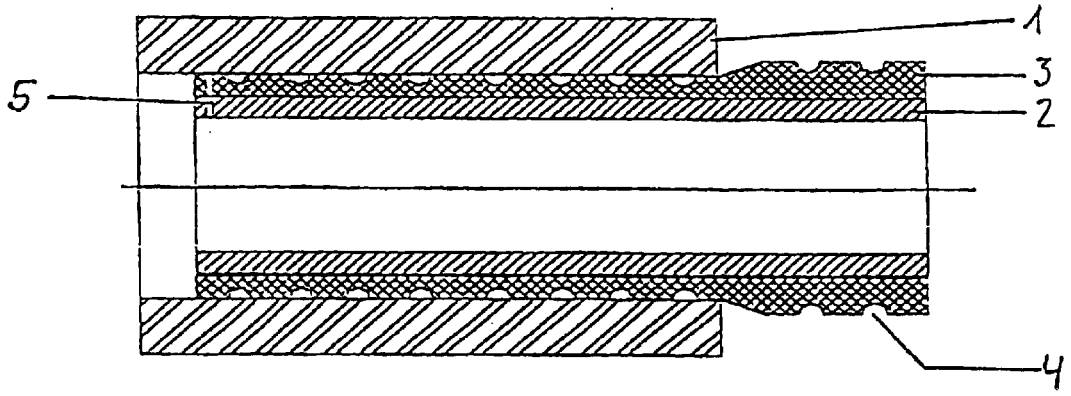
FIG. 1 is a schematic diagram of a preferred embodiment of a core cylinder with an attached expandable layer, during the attachment of a sleeve, in accordance with the present invention.

In FIG. 1, a cylindrical core cylinder 2 is shown with an expandable layer 3 attached. This expandable layer is provided with several depressions 4 on its outer circumferential surface, which in this case are fashioned as open circumferential annular channels. The expandable layer 3 can be fitted with surface layer protection on the outer surface, which however is not shown. A sleeve 1 is attached to the core cylinder 2 and the expandable layer 3 from the left in the drawing. To facilitate the attachment a channel 5 is running through the core cylinder 2 and expandable layer 3, over which the sleeve 1 can be charged on with pressure, which could, for example, be generated using a gaseous medium. FIG. 1 clearly shows that those areas of the expandable layer 3, which are already under the sleeve 1, are very compromised, whereby a part of the expandable layer material is displaced in the depressions 4.

Figure 2:
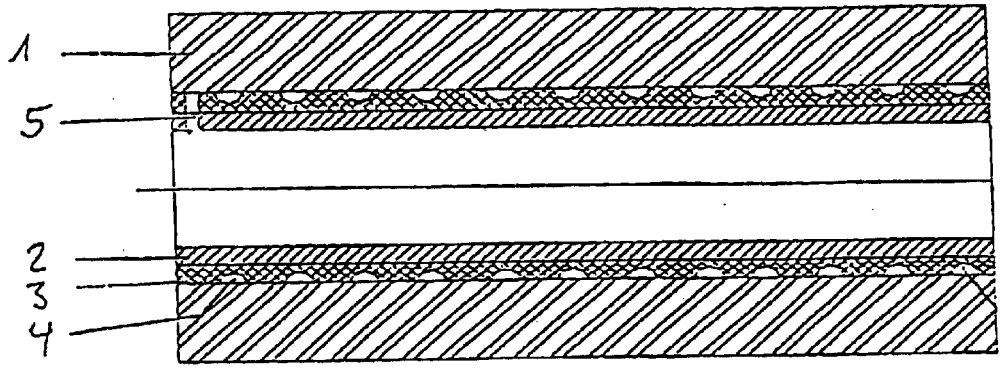
FIG. 2 is a schematic diagram of a preferred embodiment of a sleeve completely attached to the core cylinder, in accordance with the present invention.

FIG. 2 shows the completely attached sleeve.

In accordance with an embodiment of the invention, the outer or the inner circumferential surface of the expandable layer is provided with depressions. The depressions could stretch in axial and/or radial direction over the expandable layer and could have different shapes and cross sections. They could also be shaped as holes that, for example, could continue hole structures in the sleeve through the expandable layer. At least a part of the depressions, which are also shaped as open circumferential annular channels, are fashioned in accordance with a required bending compensation of the sleeve.

During the attachment of the sleeve, a part of the expandable layer material is displaced in the depressions so that the compressibility of the expandable layer increases. Depending on the distribution, shape, and geometric arrangement of the depressions the sleeve bending could be compensated for.

In accordance with an embodiment of the present invention, the depressions are, at least in part, shaped as open circumferential annular channels. The annular channels could run parallel to each other.

Another embodiment provides annular channels that are arranged equidistantly; should the bending compensation require otherwise, a grouping of annular channels in which the annular channels are placed relatively closely together is also possible.

The depressions could, at least partly, be fashioned to accommodate liquid or gaseous media, which could, for example, be used to heat or cool the sleeve. The channels could also be spray or suction channels for color.

It has proven useful to equip the expandable layer with surface layer protection on the outer circumferential surface. This ensures a longer lifespan for the expandable layer in particular when the sleeve is often exchanged.

In an embodiment of the present invention, the expandable layer is made of an elastic material with gaseous filling, for example, plastic foam or expanded polystyrene pellets.

In another embodiment, for some uses, the elastic material and/or the surface layer protection is fitted with electrical conduction particles.

The re-designed expandable layer allows other functions to be implemented whereby it is still placed on the core cylinder or as the case may be on the inner side of the sleeve, to serve as an improved compensation layer which precisely sets up the contact line, for example, between the sleeve and an impression cylinder in a flexography printer.

In another embodiment, the invention provides a core cylinder with an expandable layer made of compressible material, which could be attached to a rotary printing form between the core cylinder and a sleeve, fitted with depressions on the outer circumferential surface or on the inner circumferential surface of the expandable layer, whereby an initial section of the depressions stretches in axial direction on the expandable layer and whereby a subsequent section of the depressions stretches in radial direction over the expandable layer, whereby a part of the material of the expandable layer can be displaced in the depressions and at least some of the depressions are arranged according to a required bending compensation of the sleeve.

In another embodiment, the invention provides a rotary printing form with an expandable layer made of compressible material, which is attached to a rotary printing form between a core cylinder and a sleeve, whereby the expandable layer is fitted with depressions on its outer circumferential surface or on its inner circumferential surface, whereby in accordance with the invention an initial section of depressions stretches in axial direction on the expandable layer and whereby a subsequent section of the depressions stretches in radial direction over the expandable layer, whereby a part of the expandable layer material can be displaced in the depressions and at least a portion of the depressions is arranged according to a required bending compensation of the sleeve.

The invention characteristics disclosed above and in the drawings as well as in the claims could be significant both individually and in any chosen combination for the implementation of the invention.

The foregoing disclosure of the preferred embodiments of the present invention has been presented for purposes of illustration and description. It is not intended to be exhaustive or to limit the invention to the precise forms disclosed. Many variations and modifications of the embodiments described herein will be obvious to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A rotary printing form with an expandable layer made of compressible material, which is attached to a core cylinder before being inserting into a sleeve, wherein the expandable layer has separate recessed depressions on at least one of its outer circumferential surface and its inner circumferential surface, and wherein when the core cylinder with the expandable layer is inserted into the sleeve, an initial section of the depressions stretches in an axial direction on the expandable layer, and a subsequent section of the depressions stretches in a radial direction over the expandable layer, whereby a part of the material of the expandable layer can be displaced in the depressions and at least a part of the depressions provides channels between the expandable layer and the sleeve when the sleeve is attached to the core cylinder and the expandable layer.

2. A core cylinder with an expandable layer made of compressible material, the expandable layer adapted to be attached to a rotary printing form between the core cylinder and a sleeve, wherein the expandable layer has separate recessed depressions on at least one of its outer circumferential surface and its inner circumferential surface, and wherein when the core cylinder with the expandable layer is inserted into the sleeve, an initial section of the depressions stretches in an axial direction on the expandable layer, and a subsequent section of the depressions stretches in a radial direction over the expandable layer, whereby a part of the material of the expandable layer can be displaced in the depressions and at least a part of the depressions provides channels between the expandable layer and the sleeve.

3. An expandable layer comprising a compressible material, the expandable layer being attached to a core cylinder before inserting into a sleeve, wherein the expandable layer has separate recessed depressions on at least one of its outer circumferential surface and inner circumferential surface, wherein the recessed depressions are, at least partly, fashioned as open circumferential annular channels, and wherein when the core cylinder and the expandable layer are inserted into the sleeve, the expandable layer is between the sleeve and the core cylinder, and at least a part of the recessed depressions provides channels between the expandable layer and the sleeve.

4. The expandable layer of claim 3, wherein the annular channels run parallel to each other.

5. The expandable layer of claim 3, wherein the annular channels are placed equidistantly.

6. The expandable layer of claim 3, wherein the depressions are, at least partly, fashioned as channels for use with one of liquid media and a gaseous media.

7. The expandable layer of claim 3, wherein the expandable layer is made of an elastic material with gaseous filling.

8. The expandable layer of claim 7, wherein the elastic material is one of plastic foam and expanded polystyrene pellets.

9. The expandable layer of claim 7, wherein the elastic material is fitted with electrical conduction particles.

10. An expandable layer comprising compressible material, which is attached to a core cylinder before inserting into a sleeve, wherein the expandable layer has separate recessed depressions on at least one of its outer circumferential surface and inner circumferential surface, wherein the depressions are, at least partly, fashioned as open circumferential annular channels, and wherein when the core cylinder and the expandable layer are inserted to the sleeve, at least some of the depressions and annular channels of the expandable layer are arranged to compensate for a bending of the sleeve, and at least a part of the recessed depressions provides channels between the expandable layer and the sleeve.

11. The expandable layer of claim 10, wherein the annular channels run parallel to each other.

12. The expandable layer of claim 10, wherein the depressions are, at least partly, fashioned as channels for use with one of a liquid media and a gaseous media.

13. The expandable layer of claim 10, wherein the expandable layer is made of an elastic material with gaseous filling.

14. The expandable layer of claim 13, wherein the elastic material is one of plastic foam and expanded polystyrene pellets.

15. The expandable layer of claim 13, wherein the elastic material is fitted with electrical conduction particles.

16. An expandable layer comprising compressible material, adapted to be fitted to a rotary printing form between a core cylinder and a sleeve, wherein the expandable layer is attached to the core cylinder and has separate recessed depressions fitted on at least one of its outer circumferential surface and inner circumferential surface, wherein when the core cylinder and the expandable layer are inserted into the sleeve, an initial section of the depressions stretches in an axial direction on the expandable layer, and a subsequent section of the depressions stretches in a radial direction over the expandable layer, whereby a part of the material of the expandable layer can be displaced in the depressions and at least a part of the depressions provides channels between the expandable layer and the sleeve.

17. The expandable layer of claim 16, wherein the depressions of the subsequent section of depressions at least partly are fashioned as circumferential open annular channels running in a radial direction and which are arranged running parallel to each other.

18. The expandable layer of claim 16, wherein the depressions at least partly are fashioned as channels for use with one of liquid media and gaseous media.

19. The expandable layer of claim 16, wherein the expandable layer is made of an elastic material with gaseous filling.

20. The expandable layer of claim 19, wherein the elastic material is one of plastic foam and expanded polystyrene pellets.

21. The expandable layer of claim 19, wherein the elastic material is fitted with electrical conduction particles.

* * * * *